United States Patent [19]

Einbinder et al.

[11] 4,179,798

[45] Dec. 25, 1979

[54] METHODS OF ADJUSTING SEALED CONTACT SWITCHES

[75] Inventors: Itamar B. Einbinder, Overland Park, Kans.; Albert A. Hamilton, Belton, Mo.

[73] Assignee: Western Electric Co., Inc., New York, N.Y.

[21] Appl. No.: 895,681

[22] Filed: Apr. 12, 1978

[51] Int. Cl.[2] ..... H01H 11/00; H01H 65/00; H01H 51/28

[52] U.S. Cl. ..... 29/622; 335/151; 335/154

[58] Field of Search ..... 335/151, 152, 153, 154; 29/622

[56] References Cited

U.S. PATENT DOCUMENTS

| | | | |
|---|---|---|---|
| 3,242,557 | 3/1966 | Ellwood | 335/151 |
| 3,579,158 | 5/1971 | Kutyla | 335/151 |

*Primary Examiner*—Fred L. Braun

*Attorney, Agent, or Firm*—W. O. Schellin

[57] ABSTRACT

The position of an armature 22 located within a sealed glass envelope 12 of a sealed contact switch 11 is adjusted to meet a gap width requirement between the armature and an electrical contact 23. The glass envelope 12 is placed into a holer 48 adjacent a magnetic pole face of a magnetizing apparatus. The holder 48 supports the envelope in a position wherein the armature 22 becomes oriented perpendicular to a magnetic force field and the path of movement of the armature in closing or opening the contact extends in the same direction as that of the field. Under the influence of the applied magnetic field, the armature 22 is yieldably pulled beyond its normal path of movement toward the pole face. When the envelope is removed from the field, the armature remains in an adjusted rest position within the envelope, different from its initial rest position. The adjustment of the armature is useful in the manufacture of mercury-wetted sealed contact switches. Operations of the manufacture include a test of operating parameters. Results from the test are used to adjust the strength of the field to be applied to switches. A resulting slight or more severe adjustment of the armature results in more uniform operating characteristics of any lot of manufactured switches.

7 Claims, 5 Drawing Figures

METHODS OF ADJUSTING SEALED CONTACT SWITCHES

FIELD OF THE INVENTION

This invention relates to the manufacture of sealed contact switches. More particularly the invention relates to adjusting the position of an armature located in an envelope of a sealed contact switch. The invention is particularly useful in adjusting the position of the armature of a miniature mercury-wetted sealed contact switch. However, the invention may also be used in connection with other sealed contact switches.

DESCRIPTION OF THE PRIOR ART

A particular prior art mercury-wetted contact switch includes an elongated, cylindrical envelope. At each end of the envelope a terminal is held in place by the material of the envelope, specifically glass. Each terminal extends through the end wall of the envelope in substantially coaxial alignment with the other of the terminals. One of the terminals carries a contact. The other terminal has a reed spring mounted to its side. The reed spring extends toward the other terminal. An armature is mounted to the reed spring and positioned with respect to the two terminals, so that the armature extends from the one terminal with the spring toward and slightly past the other terminal. The spring and the armature are formed in such a manner that the armature rests in a relaxed or unenergized position in spaced relationship from the contact.

The spring flexes about a theoretical pivot axis to permit the free end of the armature to move from its unenergized position through a path against the contact and then to return to the unenergized position. The armature becomes energized to move toward and close against the contact through an application of a magnetic field in the longitudinal direction of the switch. When the field is applied, the terminal with the contact becomes a polarized magnetic pole piece which attracts the armature.

The lower part of the envelope of the mercury-wetted contact switch also is a reservoir which holds a supply of mercury. The mercury is transferred from this supply by capillary attraction along the armature and to the contact. Both, the armature and the contact are wetted by the mercury. When the armature closes against the contact, a small quantity of mercury remains with the contact. Electrical contact between the armature and the contact is therefore established through a mercury film on the contact and on the armature.

An important operating characteristic of the described mercury-wetted contact switch is its response time, or the time interval from the time that an electromagnetic coil becomes energized with a known voltage until the time at which the armature makes electrical contact with the contact. Another characteristic of the switch is its sensitivity, e.g., the minimum current through the coil required to energize the armature. These characteristics are determined to a large extent by the width of the existing gap between the armature and the contact.

A switch has a fast response time and is also most responsive when the gap between its contact and its armature is small. However, if the gap becomes too small, accumulated mercury between the contact and the armature may bridge the gap. Such a bridging prevents the electrical contact to the armature from breaking, once the switch becomes deenergized. The width of the gap, e.g., the precise position of the armature with respect to the contact when the switch is deenergized is, therefore, important.

In making the switches care is taken to align and to orient the two terminals with respect to each other before sealing them into place within the glass envelope. Also, the armature already mounted to the one terminal is pre-adjusted with respect to its axis prior to inserting the terminal with the armature into the envelope. Even with various precautions taken the gap widths between the armatures and their respective contacts in any lot of manufactured switches are not alike. Instead, the gap widths fall within a range the outer limits of which may or may not be acceptable.

It is, therefore, desirable to maintain the range of gap widths of sealed contact switches at a minimum and within an acceptable range.

SUMMARY OF THE INVENTION

According to the present invention, the position of an armature located within an envelope of a sealed contact switch is adjusted. The envelope is oriented relative to a magnetic pole face. The armature is then pulled magnetically toward the pole face and relative to the envelope beyond its elastic limit to permanently reposition the armature within the envelope.

BRIEF DESCRIPTION OF THE DRAWING

Other features and advantages of the invention will be better understood from the following detailed description when read with reference to the accompanying drawing wherein.

DETAILED DESCRIPTION

Sealed Contact Switch

Figure 1:
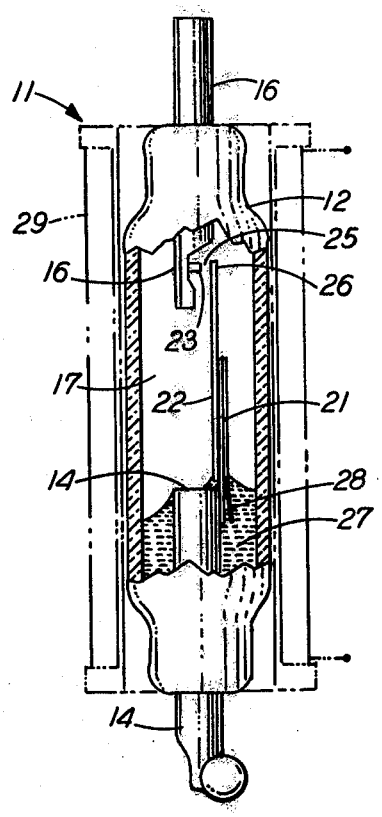
FIG. 1 is a front elevational view, partially in section, of a mercury-wetted sealed contact switch, the armature of which is adjustable in accordance with this invention.

Referring to FIG. 1, a miniature mercury-wetted sealed contact switch 11 is shown partly in section. A glass envelope 12 holds in place two terminals 14 and 16 in substantially coaxial alignment at opposite ends of the envelope 12. Both terminals 14 and 16 extend from the outside of the envelope 12 to an inner cavity 17. The glass material of the envelope 12 forms a glass tight seal with the terminals, so that in the finished product the cavity 17 holds an inert gas under pressure.

Within the cavity 17 a reed spring 21 is mounted by one end to the lower terminal 14 and extends toward the upper terminal 16. An armature 22 mounted to the reed spring 21, extends from the lower terminal 14 past the upper terminal 16. In its relaxed or unoperated position, when no forces act on the armature 22, the armature is positioned spaced apart from and adjacent the upper terminal 16. A contact 23 is mounted to the side of the upper terminal 16 which faces the armature 22 so that a gap 25 becomes established between a free end 26 of the armature and the contact 23 when the armature is resting in its unoperated position.

The envelope 12 also holds in the lower portion of the cavity 17, adjacent the lower terminal 14, a supply a mercury 27. The armature 22 is of a material which is wetted by the mercury. Also a grooved face of the armature transports mercury to its free end 26. When the switch 11 operates by becoming energized by a magnetic field extending longitudinally through the switch, the armature 22 is urged toward and closes against the contact 23. The contact 23 is also wetted by the mercury, so that mercury establishes and breaks electrical contact between the terminals 14 and 16 as the switch operates. The mercury also acts as a damping fluid. As the armature 22 closes against the contact 23 and thereafter reopens, vibrational energy generated by the motion of the armature 22 is transferred from the armature through a reed 28 to the mercury. The reed 28 is rigidly mounted to the armature in superposition to the spring. The magnetic field to operate the switch 11 is conventionally generated by a coil 29 which surrounds the envelope 12 of the switch 11.

The gap 25 determines the operating characteristics of the switch 11. While the armature 22 is already preadjusted with respect to the terminal 14, a final adjustment of the armature 22 with respect to the contact 23 is possible after the envelope 12 has been fully assembled, meaning that it has been filled with mercury and pressurized in a conventional manner.

Adjustment Apparatus

Figure 2:
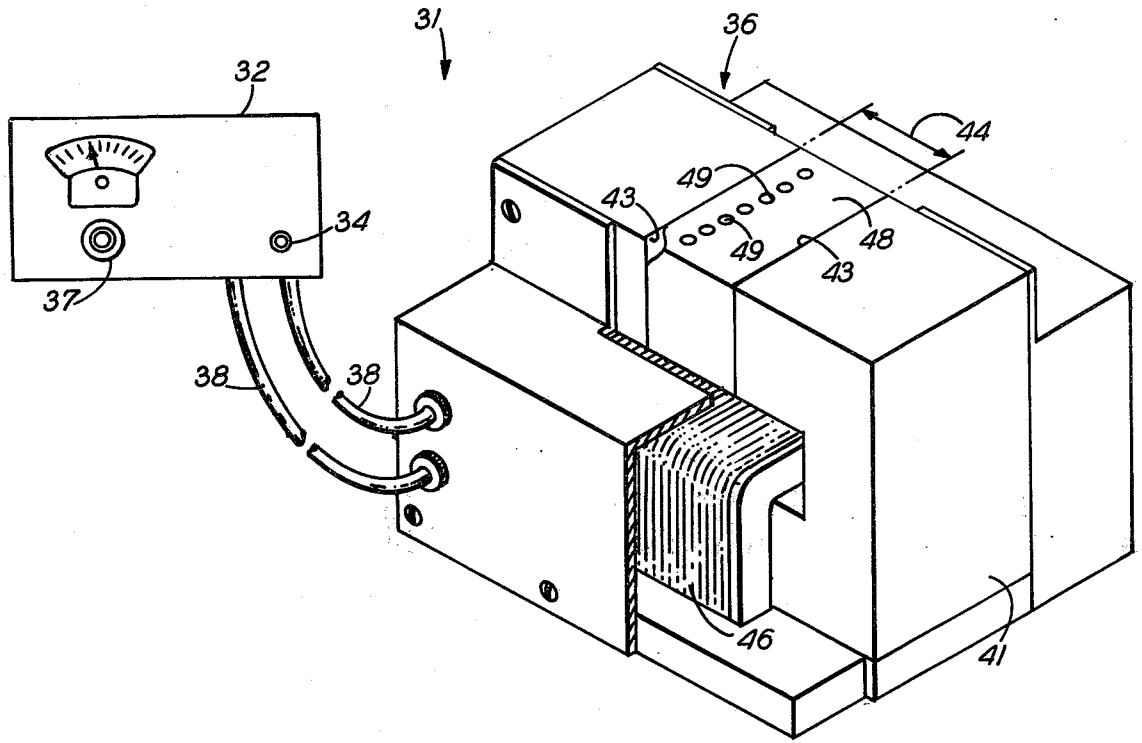
FIG. 2 is a simplified representation of an apparatus which is preferably used to adjust the armature of the switch in accordance with this invention.

Referring now to FIG. 2, there is shown an apparatus, designated generally by the numeral 31, which is used to adjust the position of the armature 22 with respect to the contact 23 after the envelope 12 has been fully assembled and sealed (switch elements are shown in FIG. 1). The apparatus 31 is substantially a commercially available magnetizing apparatus, as, for instance, one obtained from Thomas and Skinner, Inc. as Model 7515.

FIG. 2 shows a control and operating console 32 in a schematic box-like manner. The console 32 is powered by conventional 120 volt AC line voltage. The functional circuit elements within the console 32 are such that upon a depression of a button 34, a capacitively stored charge becomes discharged into a magnetizing coil and yoke assembly 36. The preferred apparatus 31 features a voltage range of 50 to 425 volts D.C. to which stored capacitors (not shown) can be charged. This range is selectively adjustable through a voltage range selector 37. The commercially available apparatus 31 is believed to include various known elements, such as a capacitor charging circuit, a bank of capacitors, a discharge circuit including a firing circuit and reverse current blocking diodes, a voltage control circuit and a power supply and its logic circuit. These elements are referred to by the supplier but are lumped into the console 32 and not shown separately in that they are part of the commercially available console.

The starting or firing of the discharge circuit results in an application of the capacitive charge through a low resistance path 38 applied to the coil and yoke assembly 36. The assembly 36 is an element of the magnetizing apparatus 31. However, the assembly 36 has been modified to accommodate the switches 11 so that the armature 22 of the switches 11 may be adjusted. The assembly 36 conventionally includes a yoke 41. The yoke 41 offers a low reluctance flux path of a high permeability material, which terminates in two opposing pole faces 43 spaced by a gap 44.

The yoke 41 becomes magnetically energized by a current discharge from the console 32 through the path 38 and a coil 46 which is tightly assembled to the yoke 41 as an element of the assembly 36. When the yoke 41 is energized a strong magnetic field exists across the gap 44. A holder 48 of a plastic and non-magnetic material occupies the gap 44. A plurality of cylindrical cavities 49 extend within the holder 48 parallel to and adjacent to one of the pole faces 43.

The cavities 49 are sized in depth and in diameter to accept one of the envelopes 12 in each. The diameter of the cavities 49 is chosen to permit an easy insertion or removal of one of the envelopes 12. At the same time a small amount of friction between the glass of the envelope 12 and the wall of the cavity prevents an accidental reorientation of the envelope 12, once it has been inserted into the cavity 49. A plastic material such as nylon, for example, or a preferred fluorinated ethylene propylene avoids scratching the glass of the envelope 12 when sliding against it. This is important because the envelopes 12 are already pressurized when they become inserted into the cavities 49 of the holder 48.

Figure 3:
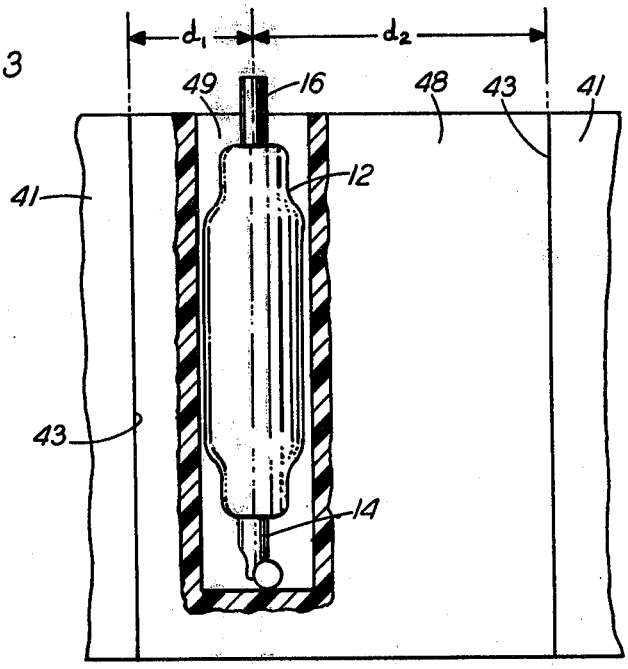
FIG. 3 shows an enlarged view of a portion of the apparatus of FIG. 2, in particular, a pole face and a section through a holder for a plurality of the switches.

FIG. 3 shows an enlarged sectional view through the holder 48 in relationship to the adjacent pole face 43. While there are two opposite pole faces 43 defining the gap 44 taken up by the holder 48, it must be realized that because of the positions of the cavities 49 within the holder closer to one of the faces 43, the closer face 43 becomes significant in attracting the armature 22 to effect the adjustment of its position within the envelope 12. It appears that when the yoke 41 is energized each pole face 43 exerts an attractive force on magnetic materials located within the gap 44. However, the attractive force appears to decrease with the square of the distance of the attracted object from the respective face 43.

The cavities 49 have, accordingly, been formed in the holder 48 closer to one of the faces 43 than to the other. In the preferred embodiment, the distance ($d_1$) from the centerline of each cavity 49 to the closest pole face 43 is approximately 0.2 inches. On the other hand, the distance $d_2$ to the other pole face 43 is approximately 0.5 inches. These distance proportions result in a force exerted by the pole face 43 closest to the cavities 49 which is believed to be approximately five times as strong as the force emanating from the other pole face.

Making the Adjustment

The described apparatus 31 is used to adjust the armatures 22 of the switches 11 in two ways. (1) The apparatus is used to open up the gap 25 between the armature 22 and the contact 23 when the gap is found to be too small. (2) The apparatus 31 is also used to close the gap 25 when the gap is found to be larger than specified. For the particular miniature switch described herein, the gap between the armature 22 and the contact 23 is adjusted to a nominal 0.008 inch. It is desirable to adjust the positions of armatures 22 which have a gap width greater than 0.009 inch or smaller than 0.007 inch.

Figure 4:
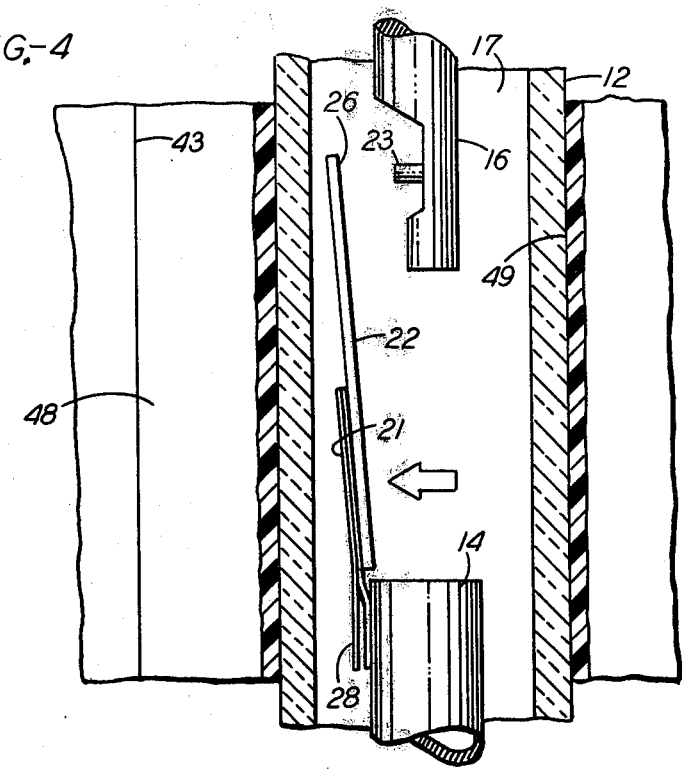
FIG. 4 shows a portion of the switch of FIG. 1 mounted in relationship to the pole face for one type of adjustment.

FIG. 4 shows a position of the sealed envelope 12 inserted into and held by the holder 48 in relationship to the closest pole face 43. When the apparatus 31 is activated to magnetically energize the pole face 43, the armature 22 becomes attracted to the pole face 43. Initially the armature 22 pivots about the flexing spring 21 until its free end 26 stops against the inside of the glass of the envelope 12. But the magnetic force tends to urge the armature 22 further in the direction of the arrow. This excursion by the armature 22 is much greater than any excursion contemplated for the armature in normal operations of the switch. The flexure or bending of the reed spring 21 exceeds its design limits.

As a result of the excessive and violent excursion of the armature 22 that takes place when the pole face 43 becomes energized, the reed spring becomes flexed beyond its yield point. For any flexure less than to the yield point of the material of the spring, the spring 21 flexes elastically. Any elastic flexure of the spring 21, however, does not result in a permanent deformation of its shape. Consequently, in normal operations, the spring 21 merely flexes elastically and the armature 22 returns to its normal, relaxed position.

However, it has been found that the force exerted by the apparatus 31 is sufficiently large on the armature to cause the spring 21 to deflect into its plastic range. This deflection results in a permanent deformation of the spring 21 which relocates or re-adjusts the position of the armature 22. Thus, after the magnetic pulse generated by the apparatus 31 has subsided and the armature returns with its free end 26 to a position adjacent to the contact 23, the gap 25 will have increased slightly.

It should be noted that in the apparatus 31, the magnetic field is applied to the magnetic parts associated with the envelope 12 in an other than normal direction. The normal direction of a field which activates or energizes the switch 11 extends longitudinally through the switch 11. Here, the force lines of the field extend perpendicular to the length of the envelope 22, and consequently, perpendicular to the armature.

The direction of the force field is believed to be significant in the ability of the magnetic pulse to actually permanently deform the spring 21. For instance, it is believed that after the free end 26 of the armature 22 strikes the glass, the force field continues to attract and pull on the lower end of the armature 22, adjacent the spring 21. It is believed that this additional force also contributes to the adjustment of the position of the armature.

The force of the apparatus 31 is adjusted to yield an acceptable increase in the gap 25 of the envelopes 12 inserted for adjustment. It has been found that any armature 22 which is positioned about 2 to 4 thousandths of an inch from the nominal relaxed position is returned to a position within the acceptable range by a magnetization pulse resulting from a charge stored to an adjusted voltage of 350 volts D.C. The field strength can, of course, be adjusted by adjusting the voltage to which the capacitors in the console 31 become charged. When the assembled envelopes 12 are routinely tested for the width of the gap 25 after assembly, they can be grouped according to the outcome of such test and adjusted in groups according to their gap width. A slightly different setting of the voltage range selector 37 may then be used to effectuate the adjustment of the gap width between the armature 22 and its respective contact 23 in each of the envelopes 12 of the groups.

Figure 5:
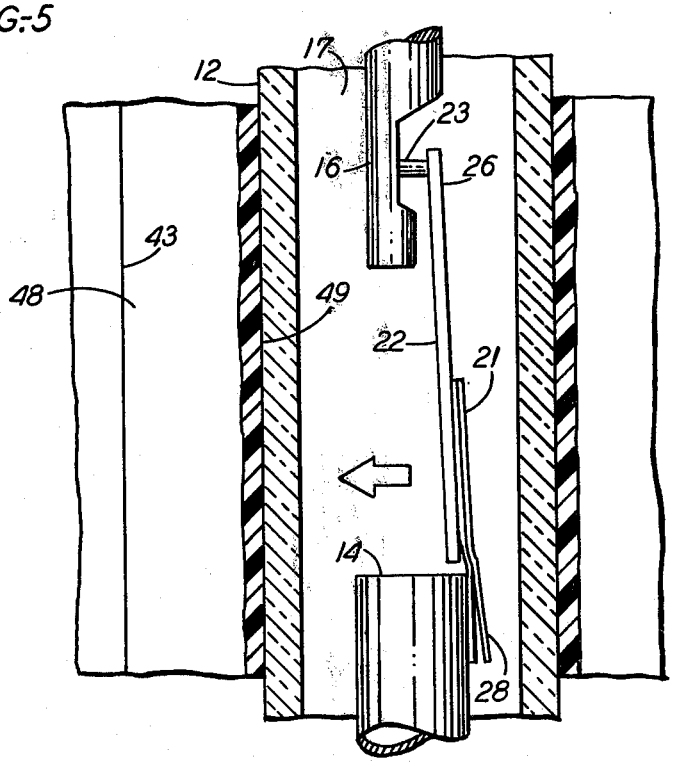
FIG. 5 shows a portion of the switch similar to that in FIG. 4, however mounted for another adjustment opposite to the adjustment in FIG. 4.

Referring to FIG. 5, there the envelope is inserted with an orientation of the armature 22 which indicates a gap 25 of an initially excessive width. When the pole face 43 is energized, the armature 22 is drawn toward the pole face 43. This motion of the armature 22 appears to be like the normal energization of the switch 11 by the coil 29. However, as already described, the force field acting on the armature 22 emanating from the pole face 43 acts perpendicular to the length of the armature 22.

Consequently, the force on the armature 22 exerted by the apparatus 31 acts on its full length to draw the lower end of the armature toward the pole face 43 in the direction of the arrow. The lower end of the armature, opposite the free end 26 is believed to become positioned slightly closer to the centerline of the envelope 12, with a corresponding permanent deformation of the spring 21 for retaining the new or adjusted position of the armature 22.

The resulting adjusted width of the gap 25 has been found to be less than the gap width prior to the adjustment when the armature was forced against the contact 23 as shown in FIG. 5. However, it also appears that an adjustment of the position of the armature 22 to decrease an initially existing gap width is harder to achieve than to increase an existing gap width with the position of the envelope 12 as shown in FIG. 4. In assembling the armatures 22 and adjusting them with respect to the contact 23 prior to sealing them in the envelopes 12, a slightly smaller than nominal gap 25 is favored. This permits the adjustment operation to be used to open the gap 25, rather than to close it with an adjustment as shown in FIG. 5.

In adjusting the gap 25 as described herein, the strength of the magnetic field is adjusted to bring the spread or range of gap widths of a quantity of manufactured envelopes 12 within the specified acceptable tolerances. The field strengths selected are tailored to the envelope 12 and its associated parts of the particularly described switch 11. It must be understood that for different switches different values of the field strength may be required. Also, when a switch is not flexibly mounted by a reed spring thinner than the thickness and magnetic material of the armature, the field strength of the adjusting magnet may have to be increased.

The adjustment of the gap width has been described herein as taking place after the pressurizing and sealing of the envelope 12. It should be understood that the adjustment of the gap can also be done after the terminals 14 and 16 are permanently positioned within the envelope 12, yet prior to the time that the envelope 12 is permanently sealed. However, the adjustment of the gap after sealing the envelope 12 in the manner described is presently preferred.

Also while the material of the terminals 14 and 16 and of the spring 21 and the armature 22 are sufficiently annealed so as not to retain any induced magnetic orientation with the presently used magnetic adjusting force, it is advantageous to test the adjusted armatures for any retained magnetism. It may then be necessary to subject the envelopes 12 to a demagnitizing field after adjustment.

While the present invention has been described within the framework of its applicability to a particular product, e.g., the described switch 11, it is to be understood that various modifications and changes may be made as refinements but without departing from the scope and spirit of the present invention.

What is claimed is:

1. A method of adjusting a normally unoperated position of an armature with respect to a contact, the armature and the contact being located with an envelope of a sealed contact switch, the armature being resiliently hinged at one end by a reed spring to elastically deflect about the hinged end of the armature in a path between the unoperated position in which another end opposite the hinged end of the armature is located adjacent to and spaced from the contact and an operated position in which said another, opposite end of the armature becomes located against the contact, the method comprising:

determining the width of a gap between said another end opposite the hinged end of the armature and the contact when the armature is located in the normally unoperated position;

orienting the envelope with respect to a magnetic pole face such that the armature becomes positioned substantially perpendicular to the direction of the magnetic field, the path becomes substantially aligned with the direction of the magnetic field and the contact becomes located between the magnetic pole face and the armature when the gap width has been found to be greater than a desired value of the gap width, and the armature becomes located between the contact and the pole face when the gap width has been found to be less than the desired value of the gap width; and magnetically pulling the armature toward the pole face to deflect the reed spring beyond its elastic limit of deflection to thereby permanently reposition the armature within the envelope when located in the normally unoperated position spaced from the contact, such that the value of the gap width deviates less from the desired value of the gap width than the width prior to magnetically pulling the armature.

2. A method according to claim 1, wherein magnetically pulling the armature comprises applying an electromagnetic force.

3. A method of adjusting the width of a gap between a fixed contact and a relaxed position of an armature, the contact and the armature being located within an envelope of a sealed contact switch, the armature being elastically pivoted about one end thereof to move in a path from the relaxed position through the width of the gap into engagement with the contact, which comprises:

ascertaining a deviation of the width of the gap between the armature and the contact from a desired width when the armature is located in the relaxed position;

pulling the armature from its relaxed position to the limit of its normal travel and against the contact upon the width of the gap having been ascertained as being greater than the desired width; and applying a force beyond that required to pull the armature to the limit of its normal travel, to plastically reposition the armature within the envelope, whereby the width of the gap is changed upon return of the armature to the relaxed position.

4. A method according to claim 3, wherein the armature is of a magnetic material and pulling the armature comprises applying a magnetic field through the armature, and applying a force comprises increasing the force to a magnitude to permanently change the relaxed position of the armature with respect to the contact.

5. A method according to claim 4, wherein the magnetic field is applied perpendicular to a field which would normally be applied to energize the switch and adjusted in strength on the basis of the width of the gap as including a deviation from the desired width.

6. A method according to claim 5, wherein the sealed contact switch is a mercury-wetted sealed contact switch and the magnetic field is applied by energizing a coil of an electromagnet.

7. A method according to claim 1, wherein pulling the armature to the limit of its normal travel further comprises pulling the armature away from the contact and toward the wall of the envelope upon the width of the gap being less than the desired width.

* * * * *

UNITED STATES PATENT AND TRADEMARK OFFICE

CERTIFICATE OF CORRECTION

PATENT NO. : 4,179,798

DATED : December 25, 1979

INVENTOR(S) : Itamar B. Einbinder and Albert A. Hamilton

It is certified that error appears in the above-identified patent and that said Letters Patent are hereby corrected as shown below:

Column 8, claim 7, line 35, claim "1" should be claim --6--.

Signed and Sealed this

*Sixth* Day of *May 1980*

[SEAL]

*Attest:*

SIDNEY A. DIAMOND

*Attesting Officer*

*Commissioner of Patents and Trademarks*